United States Patent [19]

Emmerich

[11] 4,206,821

[45] Jun. 10, 1980

[54] ROOF DRILL AND DRILL ROD SYSTEM

[75] Inventor: Kenneth C. Emmerich, Lexington, Ky.

[73] Assignee: Fansteel Inc., North Chicago, Ill.

[21] Appl. No.: 940,709

[22] Filed: Sep. 8, 1978

[51] Int. Cl.[2] ..... E21C 15/00

[52] U.S. Cl. ..... 175/321; 279/103; 403/287; 403/365; 175/315

[58] Field of Search ..... 175/87, 315, 320, 321; 279/1 DC, 2 A, 102, 103; 403/287, 365

[56] References Cited

U.S. PATENT DOCUMENTS

| | | | |
|---|---|---|---|
| 748,398 | 12/1903 | Middleton | 279/103 |
| 2,479,698 | 8/1949 | Paquin | 279/103 X |
| 2,759,734 | 8/1956 | Velepec | 279/102 |
| 3,519,091 | 7/1970 | Leibee et al. | 175/320 |
| 4,009,760 | 3/1977 | Hansen et al. | 175/320 |
| 4,086,972 | 5/1978 | Hansen et al. | 175/320 X |
| 4,092,078 | 5/1978 | Klotz et al. | 403/287 X |

*Primary Examiner*—Ernest R. Purser
*Assistant Examiner*—Nick A. Nichols, Jr.
*Attorney, Agent, or Firm*—Barnes, Kisselle, Raisch & Choate

[57] ABSTRACT

An improved roof drill bit and roof drill driving assembly which is characterized as a "hands off" type in which the drill, driver, and drill extension are designed and assembled to have a stability which enables the operator to avoid guiding the drill with his hands. An improved drill bit prevents plugging of the assembly when used with suction systems and provides a heavier wall construction. Special adaptors are provided for driving drills and drill extensions.

3 Claims, 17 Drawing Figures

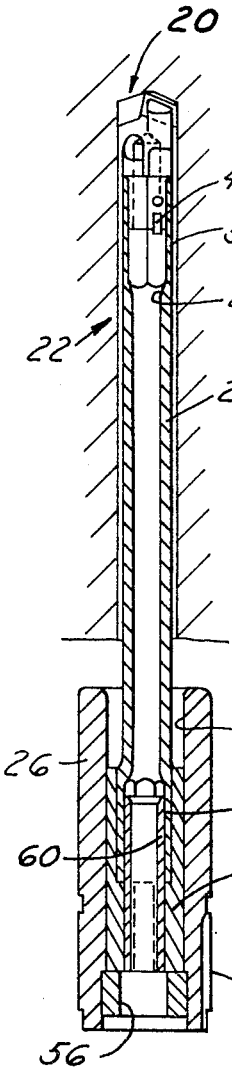
FIG. 1
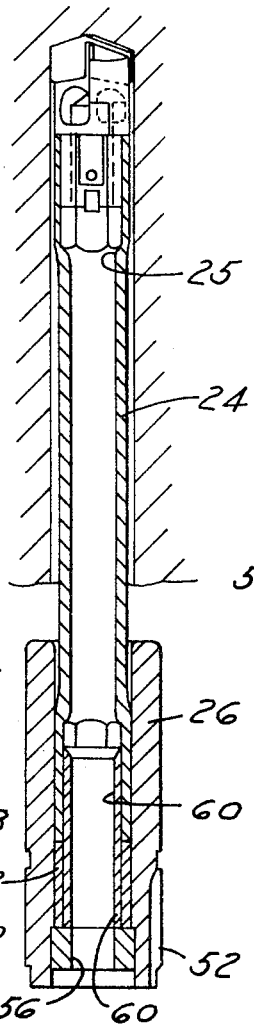
FIG. 2
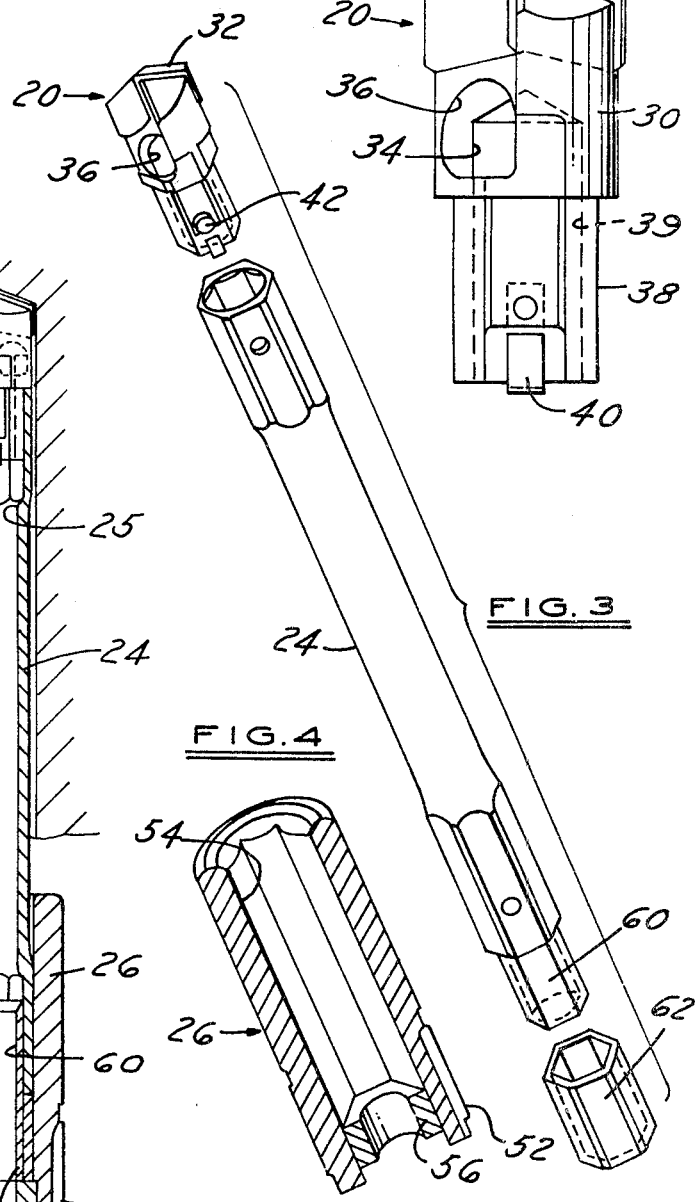
FIG. 3
FIG. 4
FIG. 5
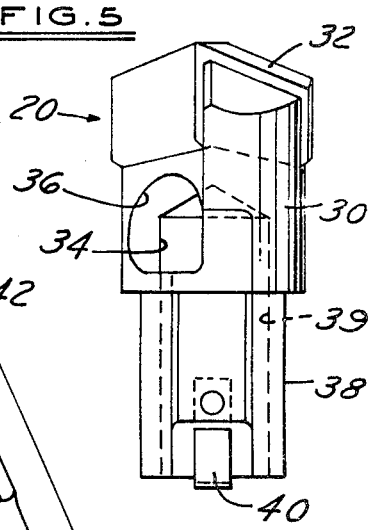
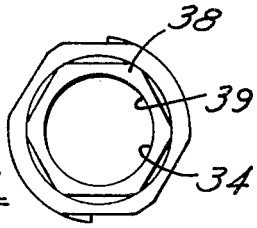
FIG. 7
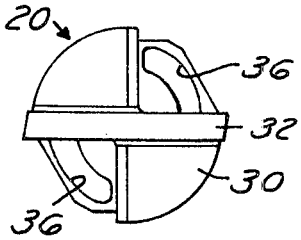
FIG. 6

ROOF DRILL AND DRILL ROD SYSTEM

FIELD OF INVENTION

Rock drilling and mining bits and driver extensions for water cooled and air cooled (suction) systems, particularly useful in roof drilling.

BACKGROUND OF THE INVENTION

Roof bolters are drilling operators who drill holes in the arched roofs of mining tunnels and install bolts in the form of metal cores and plastic fillers to reinforce the roof to prevent collapse. This avoids cumbersome scaffolding supports and framing. Previous roof drilling systems have required the operator to guide the rotating drill with one hand while supporting the assembly with the other hand at least until the drill is started. Numerous accidents have dictated the necessity for a structure which avoids the need for hand guiding of the rotating bit.

An example of a roof drilling system is illustrated in U.S. patent to Leibee and Oaks, U.S. Pat. No. 3,519,091, issued July 7, 1970.

It is, therefore, an object of the present invention to provide a rugged drill bit which has wall strength to withstand the rigours of the drilling, with interior and coolant passages which permit maximum coolant volume while preventing the plugging of the passages.

It is a further object to provide a drive system which has maximum drive surface, thus giving the necessary axial stability while providing ample drive contact.

A still further object is the provision of interior coolant passages which allow free flow of the fines and chips resulting from the drilling operation.

Other objects and features of the invention will be apparent in the following description and claims in which the principles of the invention are set forth together with details of structure and operation, all in connection with the best mode presently contemplated, which will enable a person skilled in the art to practice the invention.

DRAWINGS

Drawings accompany the disclosure, and the various views thereof may be briefly described as:

FIG. 1, an assembly view of a bit and driver assembly according to the present invention.

FIG. 2, a modified enlarged bit and driver assembly with a variation in the adaptor.

FIG. 3, an exploded perspective view of a bit, middle extension and adaptor.

FIG. 4, a perspective view in section of a driver element.

FIG. 5, a view of a bit with coolant passages for use in the assembly.

FIG. 6, a view of the cutting end of the bit.

FIG. 7, a view of the shank end of the bit.

FIG. 8, a view of a dry bit adaptor with a collet retainer.

FIG. 9, an end view of the bottom of the adaptor shown in FIG. 8.

FIG. 10, an end view of the top of the adaptor shown in FIG. 8.

FIG. 11, a side view of the adaptor taken at arrow 11 on FIG. 10 and on lines 11—11 of FIG. 8.

FIG. 12, an elevation of a dry bit adaptor having a split collet retainer taken on line 12—12 of FIG. 14.

FIG. 13, a section on line 13—13 of FIG. 12.

FIG. 14, a view of the adaptor of FIG. 12 at a 90° angle to the FIG. 12 showing.

FIG. 15, a view of the bit end of the adaptor of FIG. 12.

FIG. 16, an end view from the bottom of FIG. 14.

FIG. 17, a view of a "dry" bit, i.e., a bit without coolant passages.

DETAILED DESCRIPTION OF THE INVENTION

Figure 15:
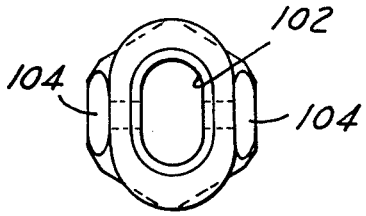

In FIG. 1, a drill assembly is shown wherein a drill bit 20 is into a roof area 22 driven by a middle extension steel 24 which in turn is driven in a drive chuck 26. The details of bit 20 are shown in FIG. 5 wherein a head body 30 has a diametrically disposed spade bit 32 with angled wings. The body of the bit has a large central bore 34 which is open to coolant passages 36 opening into the cutaway quadrants of the bit. The effective area of the central bore is larger than the effective area of the coolant passages 36. For example, a bit with a 9/16" passage 36 should have a central passage at least as large and preferably larger than this dimension, for example, about ¾" in diameter. For a bit with 7/16" ports, a core passage of at least ½" and up to ⅝" would be appropriate.

The bit 20 has a hexagonal shank 38 with an axial passage 39 connecting to the bore 34 of the drill body. A U-spring clip 40 with a retention button 42 serves to lock the bit in the upper end of the middle drive extension steel 24.

The cutting end of the bit 20 is shown in FIG. 6. The profile of the openings 36 is arcuate as viewed from the end. The openings or ports 36 are preferably angled at 45° to the axis of the bit to provide added strength and improve the flow. The shank end of the bit is illustrated in FIG. 7 where the axial passage 39 in the shank is concentric with passage 34 in the body of the bit.

The middle drive extension steel 24 of FIG. 1 is formed at each end as a hexagonal socket 50 with a hexagonal cross-section on the inside and outside. The enlarged end passages are chamfered down at 25 to the main passage in the drive extension 24 to insure smooth flow area. This avoids obstructions where dust and tailings might build up and cause blockage. The "no hands" drive chuck 26 has a drive end 52 which mounts to the rotary drive source and has a hexagonal central passage 54. A stop collar 56 is secured in a counterbore in the bottom of the chuck 26. A chuck adaptor 58 has a stepped hexagonal bore which at the larger end receives the bottom end of drive extension 24. At the smaller end, the bore receives one end of a hexagonal tube 60 which projects from the driver steel 24. The chuck adaptor 58 seats on the collar 56 and the bottom of the extension drive steel 24 seats at the shoulder between the stepped bores in adaptor 58.

Thus, a very stable joint is achieved between the drive chuck 26 and the drive steel 24 and the axial length of the drive is at a maximum to reduce the overall stress on the drive elements. In addition, the extension drill steel 24 is confined externally and internally against distortion and collapse. This insures a positive drive with the drill steel which is identical at both ends to serve as a drive end or a bit retaining end.

In FIGS. 2 and 3, a modified adaptor is illustrated. The drive extension 24 has a hexagonal tube 60 seated in the bottom end as shown. A short hexagonal tube 62 telescopes onto the projecting end of tube 60 and this assembly slips into the drive chuck 26, seating against the stop collar 56 as illustrated in FIG. 2. Thus, in each case, the standard drive chuck can accommodate the adaptors to provide a long axial contact with the drive steel and the stability necessary to eliminate the necessity of the operator holding the revolving tool elements of the system. The tube 60 has chamfered portions internally at each end to provide smooth flow and prevent build-up as well as to aid in assembly.

Figure 8:
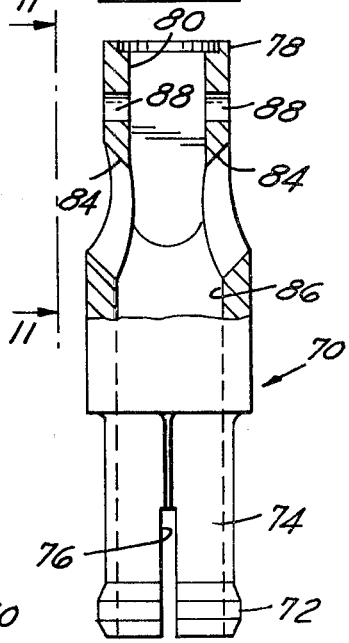
Figure 17:
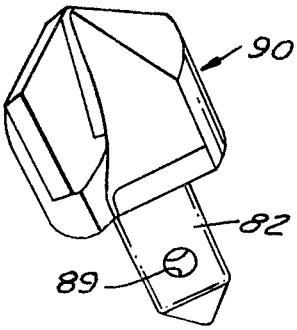
Figure 13:
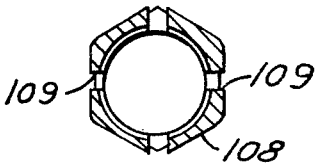

In FIGS. 8 to 16, adaptors are illustrated for use with so-called "dry" bits, i.e., solid bits which do not have coolant passages and central passages. In FIG. 8, a dry bit adaptor body 70 has a collet retainer 72 in a suitable annular recess in the bottom end 74, this end having a hexagonal cross-section to telescope into the top end of a middle drive extension 24. The bottom end 74 may be provided with axial circumferentially spaced slots 76 to permit the radial flexing to assist the collet retention. The top end 78 of the adaptor 79 has an oval end with a square recess 80 to receive the square end of dry bit shank shown at 82 in FIG. 17. Passages 84 in the wall of the top end connect with the axial passage 86 in the adaptor. Holes 88 are used for the retention of the shank of the dry bit which has registering holes 89.

Figure 10:
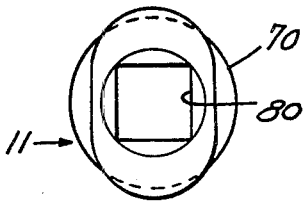
Figure 11:
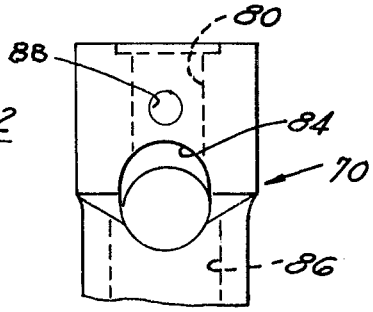
Figure 16:
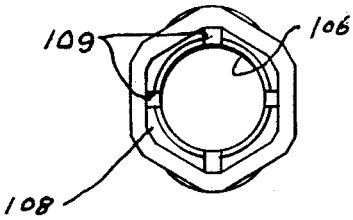
Figure 9:
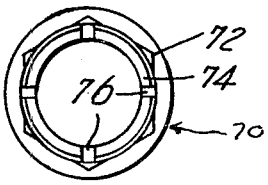

FIG. 9 shows the collet end of the adaptor 70. FIG. 10 shows the bit end of the adaptor. FIG. 11 shows a side view of the top end of the adaptor in a view on line 11—11 of FIG. 8 giving the side profile of the holes 84. Thus, a dry bit 90 shown in FIG. 17 will be retained in the adaptor 70 which will have a stable and secure connection with the middle drive extension 24. The effective diameter of the openings 84 will be preferably less than the diameter of passage 86 so that no chips or tailings can enter which will not flow down the internal passage 86.

Figure 12:
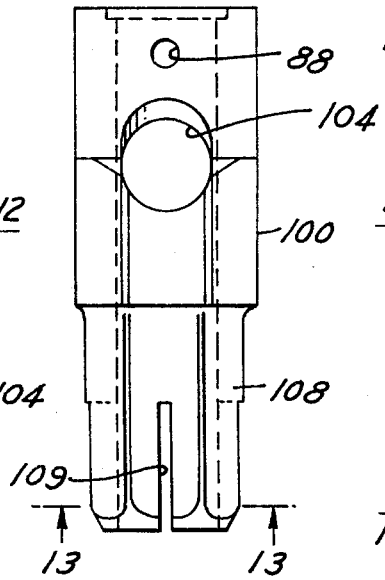
Figure 14:
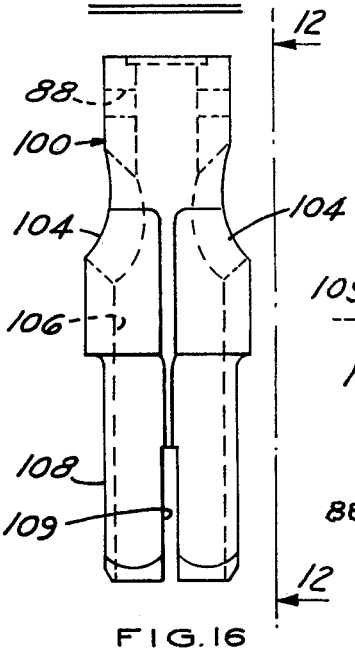

In FIG. 12, a split shank seat adaptor is shown having a body 100, oval in cross-section, at the top end as shown in the end view of FIG. 15. In this case, the end has an oval recess 102 to receive an oval shank a dry bit. Side wall passages 104 are again angled into the body to join the central passage 106. The bottom end 108 is axially split with axial circumferential spaced slots 109 and is hexagonal in cross-section as shown in the sectional view of FIG. 13 and the end view of FIG. 16.

Thus, a standard middle drive extension 24 with identical ends can be utilized for both hollow bits and solid dry bits and also with standard drive chuck to provide a stable "no-hands" assembly which eliminates the difficulties and dangers previously encountered. It will be noted that this has been accomplished with no flow restriction, i.e., no ensmalling of the main flow passage internally, thus insuring good flow characteristics for the system.

I claim:

1. In an apparatus for roof drilling and the like for operation without hand guidance which comprises a telescoping hollow, fluid cooled assembly of a drill bit, a middle extension steel, and a drive chuck, that improvement which comprises:

(a) a hollow middle extension steel having polygonal end portions with identical internal recesses at each end of polygonal cross-section, each end being adapted to receive a complemental shank of a drill bit, (b) a drive chuck in the form of a hollow cylinder with a polygonal interior passage to receive either end of said extension steel having a stop collar forming a shoulder at one end of the passage, and (c) an adaptor assembly interposed between the inserted end of said middle extension steel and said drive chuck comprising a drive and reinforcing tube having a polygonal cross-section fitted into an internal recess at one end of said steel and extending therefrom, a chuck adaptor tube having an internal recess complemental to said drive tube extension to slideably receive said extension and an external shape complemental to and slideably received in the interior of said drive chuck and seated against said stop collar.

2. An apparatus as defined in claim 1 in which said chuck adaptor tube has a stepped internal diameter to receive complementally one end of a drill steel in a larger diameter and one end of said drive tube extension in the smaller diameter.

3. An apparatus as defined in claim 1 in which said chuck adaptor tube comprises a straight walled tube received internally in a complemented recess in said drive chuck having a dimension shorter than said drive chuck and receiving said drive tube extension internally throughout its axial length.

* * * * *